US007425189B1

(12) United States Patent
Eschenbach

(10) Patent No.: US 7,425,189 B1
(45) Date of Patent: Sep. 16, 2008

(54) ELLIPTICAL SKIER EXERCISE APPARATUS

(76) Inventor: Paul William Eschenbach, 290 S. Tyger La., Roebuck, SC (US) 29376

( * ) Notice: Subject to any disclaimer, the term of this patent is extended or adjusted under 35 U.S.C. 154(b) by 0 days.

(21) Appl. No.: 11/716,064

(22) Filed: Mar. 9, 2007

(51) Int. Cl.
*A63B 22/04* (2006.01)

(52) U.S. Cl. ..... 482/52; 482/51; 482/57

(58) Field of Classification Search ..... 482/51, 482/52, 70, 71, 114, 115, 53, 57, 907
See application file for complete search history.

(56) References Cited

U.S. PATENT DOCUMENTS

| | | | | | |
|---|---|---|---|---|---|
| 3,650,528 | A | * | 3/1972 | Natterer | 482/71 |
| 3,756,595 | A | * | 9/1973 | Hague | 482/51 |
| 4,396,189 | A | * | 8/1983 | Jenkins | 482/71 |
| 4,595,195 | A | * | 6/1986 | Miehlich | 482/71 |
| 4,607,839 | A | * | 8/1986 | Knudson | 482/71 |
| 4,708,338 | A | * | 11/1987 | Potts | 482/52 |
| 4,783,069 | A | * | 11/1988 | Cottee | 482/71 |
| 4,786,050 | A | * | 11/1988 | Geschwender | 482/57 |
| 4,838,543 | A | * | 6/1989 | Armstrong et al. | 482/53 |
| 4,869,496 | A | * | 9/1989 | Colombo | 482/71 |
| 5,007,631 | A | * | 4/1991 | Wang | 482/52 |
| 5,192,258 | A | * | 3/1993 | Keller | 482/71 |
| 5,284,460 | A | * | 2/1994 | Miller et al. | 482/51 |
| 5,316,530 | A | | 5/1994 | Romer | 482/71 |
| 5,374,228 | A | * | 12/1994 | Buisman et al. | 482/71 |
| 5,391,130 | A | * | 2/1995 | Green et al. | 482/71 |
| 5,419,747 | A | * | 5/1995 | Piaget et al. | 482/51 |
| 5,496,239 | A | * | 3/1996 | Kallman et al. | 482/71 |
| 5,518,470 | A | | 5/1996 | Piaget et al. | 482/51 |
| 5,536,225 | A | | 7/1996 | Neuberg et al. | 482/71 |
| 5,575,739 | A | | 11/1996 | Piaget et al. | 482/51 |
| 5,595,554 | A | | 1/1997 | Maresh | 482/52 |
| 5,665,033 | A | | 9/1997 | Palmer | 482/71 |
| 5,692,995 | A | | 12/1997 | Alvarez et al. | 482/71 |
| 5,718,658 | A | * | 2/1998 | Miller et al. | 482/71 |
| 5,749,811 | A | | 5/1998 | Wilson | 482/71 |
| 5,904,641 | A | * | 5/1999 | Huang | 482/131 |
| 5,906,561 | A | * | 5/1999 | Lin | 482/52 |
| 6,017,294 | A | * | 1/2000 | Eschenbach | 482/52 |
| 6,033,227 | A | * | 3/2000 | Ishige | 434/253 |
| 6,042,510 | A | * | 3/2000 | Miller | 482/51 |
| 6,042,512 | A | * | 3/2000 | Eschenbach | 482/52 |
| 6,077,202 | A | * | 6/2000 | Gray | 482/57 |
| 6,117,052 | A | * | 9/2000 | Frost et al. | 482/52 |
| 6,132,339 | A | * | 10/2000 | Wang et al. | 482/53 |
| 6,139,473 | A | | 10/2000 | Koyama | 482/8 |
| 6,168,552 | B1 | * | 1/2001 | Eschenbach | 482/52 |
| 6,220,990 | B1 | * | 4/2001 | Crivello | 482/51 |
| 6,231,484 | B1 | * | 5/2001 | Gordon | 482/71 |
| 6,234,935 | B1 | * | 5/2001 | Chu | 482/51 |
| 6,620,080 | B1 | * | 9/2003 | Gray | 482/52 |

(Continued)

*Primary Examiner*—LoAn H. Thanh
*Assistant Examiner*—Daniel F Roland

(57) ABSTRACT

The present invention relates to a standup exercise apparatus that simulates downhill skiing with arm exercise. More particularly, the present invention relates to an exercise machine having separately supported pedals for the feet and arm exercise coordinated with the motion of the feet. Each pedal follows an separate elongate curve with lateral movement. As one pedal moves downward on the inside portion of one pedal curve, the other pedal moves sideways upward following the outer portion of the other pedal curve. A pair of cranks rotate in opposite directions when driven by the pedal movement. The orientation of the pedal curves is adjustable to exercise leg muscles differently. Arm exercise is coordinated with the foot pedal movements.

20 Claims, 5 Drawing Sheets

U.S. PATENT DOCUMENTS

| | | | | |
|---|---|---|---|---|
| 6,641,506 | B1 | 11/2003 | Yang | 482/52 |
| 6,679,813 | B1 | 1/2004 | Gray | 482/71 |
| 6,830,538 | B2 * | 12/2004 | Eschenbach | 482/52 |
| 6,837,829 | B2 * | 1/2005 | Eschenbach | 482/52 |
| 6,849,032 | B2 * | 2/2005 | Chu | 482/51 |
| 7,014,596 | B2 * | 3/2006 | Gray | 482/52 |
| 7,108,638 | B2 * | 9/2006 | Snyderman | 482/57 |
| 7,115,073 | B2 * | 10/2006 | Nizamuddin | 482/51 |
| 7,270,625 | B2 * | 9/2007 | Miller | 482/52 |
| 2004/0097335 | A1 * | 5/2004 | Chu | 482/51 |
| 2004/0097338 | A1 * | 5/2004 | Gray | 482/52 |
| 2004/0162193 | A1 * | 8/2004 | Gray et al. | 482/70 |
| 2004/0229733 | A1 * | 11/2004 | Gray | 482/71 |
| 2004/0235621 | A1 * | 11/2004 | Eschenbach | 482/52 |
| 2005/0014613 | A1 * | 1/2005 | Chu | 482/79 |
| 2005/0107219 | A1 * | 5/2005 | Miller | 482/52 |
| 2005/0209058 | A1 | 9/2005 | Yu | 482/52 |
| 2005/0245357 | A1 * | 11/2005 | Horvath | 482/51 |
| 2006/0046902 | A1 | 3/2006 | Chang | 482/52 |
| 2006/0264301 | A1 * | 11/2006 | Kuo | 482/52 |
| 2006/0287168 | A1 * | 12/2006 | Nizam | 482/71 |
| 2007/0027001 | A1 * | 2/2007 | Alessandri et al. | 482/51 |
| 2007/0161465 | A1 * | 7/2007 | Eschenbach | 482/52 |
| 2007/0287602 | A1 * | 12/2007 | Hsiung | 482/71 |
| 2008/0020902 | A1 * | 1/2008 | Arnold | 482/51 |
| 2008/0045386 | A1 * | 2/2008 | Edmondson | 482/70 |
| 2008/0051258 | A1 * | 2/2008 | Schmehl et al. | 482/52 |
| 2008/0167164 | A1 * | 7/2008 | Wang | 482/52 |

* cited by examiner

ELLIPTICAL SKIER EXERCISE APPARATUS

BACKGROUND OF THE INVENTION

1. Field

The present invention relates to a standup exercise apparatus that simulates downhill skiing with arm exercise. More particularly, the present invention relates to an exercise machine having separately supported pedals for the feet and arm exercise coordinated with the sideways elliptical motion of the feet.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve moving forward and rearward of an operator to simulate the motions of jogging and slight climbing. There is a need for an elliptical exercise machine capable of lateral or sideways foot movements similar to downhill skiing which occurs during switchbacks.

The teeter-totter category addresses side to side lateral foot movements in Piaget et al. U.S. Pat. Nos. 5,518,470 and 5,575,739, Yu in U.S. patent application No. 2005/0209058, Yang in U.S. Pat. No. 6,641,506 and Gray in U.S. Pat. No. 6,679,813. The category of ski simulators also display lateral foot movement such as Koyama et al. in U.S. Pat. No. 6,139,473, Romer in U.S. Pat. No. 5,316,530, Neuberg et al. in U.S. Pat. No. 5,536,225, Palmer in U.S. Pat. No. 5,665,033, Wilson in U.S. Pat. No. 5,749,811, Alvarez in U.S. Pat. No. 5,692,995 and Chu in U.S. Pat. No. 6,849,032. Some sideways foot movement is added to the elliptical apparatus shown by Chang in U.S. patent application No. 2006/0046902.

There is a need for a pedal operated exercise machine that can be safely operated in the standup position whereby the arms and legs can be exercised with the feet moving through a generally lateral elliptical movement to exercise the inner and outer leg muscles in a manner not shown in prior art. There is also a need to adjust the orientation of the lateral elliptical pedal curve to exercise the leg muscles differently during lateral downhill ski simulation.

It is one objective of this invention to provide lateral elliptical pedal movement with a path generating linkage coordinated with arm exercise to exercise the inner and outer leg muscles without joint impact. Another objective of this invention is to provide some lateral rotation of the ankles to strengthen muscles related to ankle control important in a variety of sports. Another object of this invention is to provide an adjustable pedal motion.

SUMMARY OF THE INVENTION

The present invention relates to the kinematic motion control of pedals which simulates the lateral movements of downhill skiing during switchbacks. More particularly, apparatus is provided that offers variable intensity exercise through a leg operated cyclic motion in which the pedal supporting each foot is guided through successive sideways positions during the motion cycle while a load resistance acts upon the mechanism.

The pedals are guided through a horizontally elongated curve motion while the sideways pedal angles vary during the pedal cycle to add some ankle exercise. Arm exercise is by arm levers coordinated with the mechanism guiding the foot pedals.

In the preferred embodiment, the apparatus includes a separate pedal for each foot, each pedal positioned on one end of a foot support which is pivotally connected to a crank and a guide. The cranks are connected by a coupling device such as a gear pair which rotate in opposite directions with the cranks. The guides are rocker links pivotally connected to the foot supports and the framework at rocker link pivots. The rocker link pivots can be relocated manually or by actuator to change the pedal motion.

Arm exercise is provided with handles pivotally connected to the framework and coordinated with the foot supports. When the foot is up, the handle corresponding to that foot is generally up.

Load resistance is imposed upon the crank arms through pulleys and belts from a flywheel and frictional resistance. A control system regulates the load on the flywheel to vary the resistance to exercise. The resistance can be varied during operation through a control system within easy reach of the operator. Other forms of load resistance such as an alternator, magnetic, air, fluid, etc. may also be used.

Movement of the pedals cause the pedals to follow a horizontally elongated path similar to an ellipse where the longer major axis of the ellipse is generally horizontal to provide the lateral skiing motion. The shorter minor axis of the ellipse provides the sideways up and down foot motion.

An alternate embodiment is shown using adjustable tracks as guides for the foot supports. An actuator and control system adjusts the incline of the tracks to exercise leg muscles differently.

Another alternate embodiment is shown where the cranks are positioned at the ends of the foot supports to produce different pedal curves.

In summary, this invention provides the operator with stable foot pedal support having motions that simulate downhill skiing with very low joint impact and upper body exercise. The pedal motion exhibits horizontally oriented elliptical lateral foot motion providing exercise for the inner and outer leg muscles which is not available in elliptical cross trainers.

DETAILED DESCRIPTION OF THE EMBODIMENTS

Figure 1:
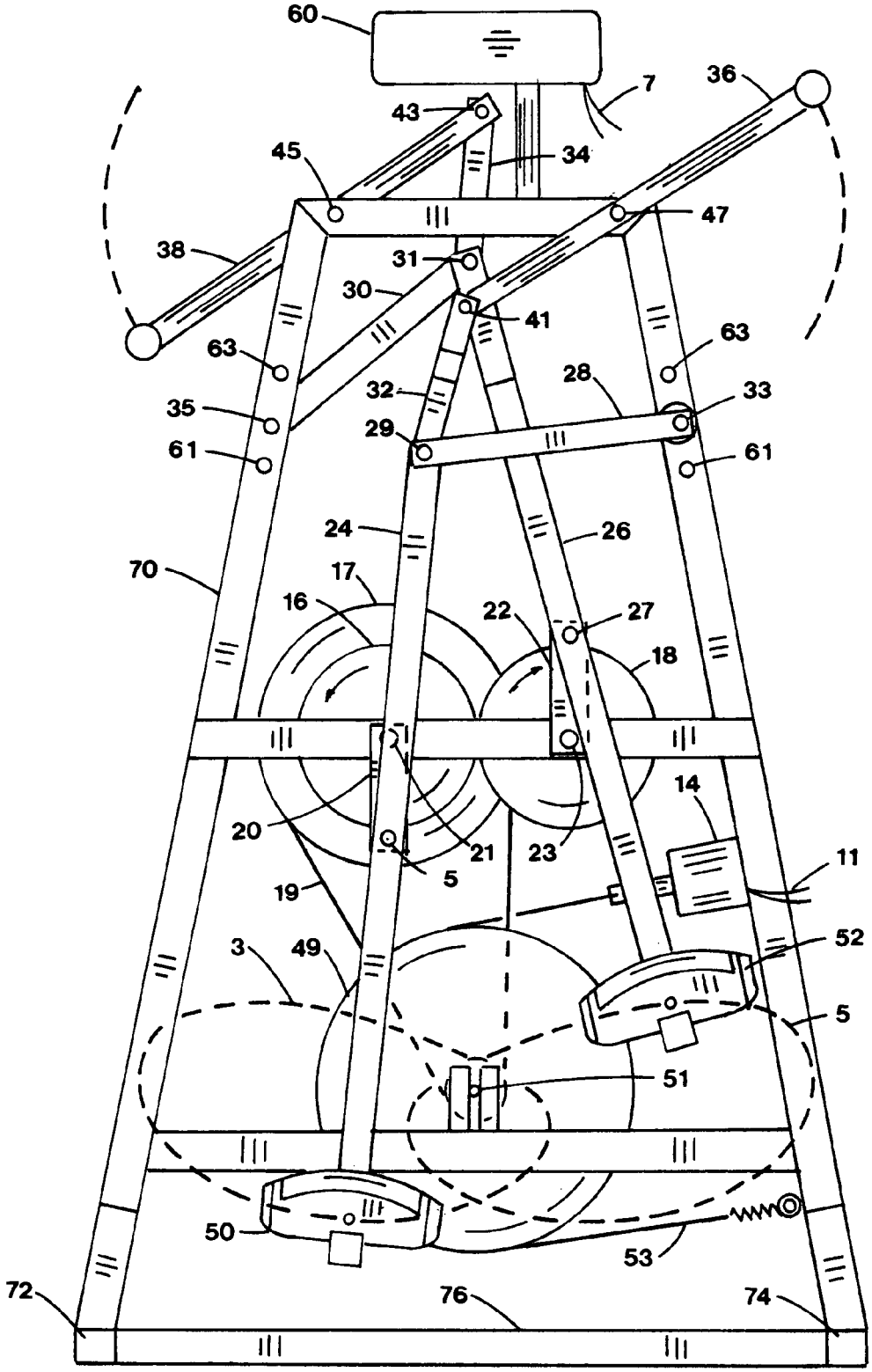
FIG. 1 is a frontal view of the preferred embodiment of an exercise machine constructed in accordance with the present invention.
Figure 2:
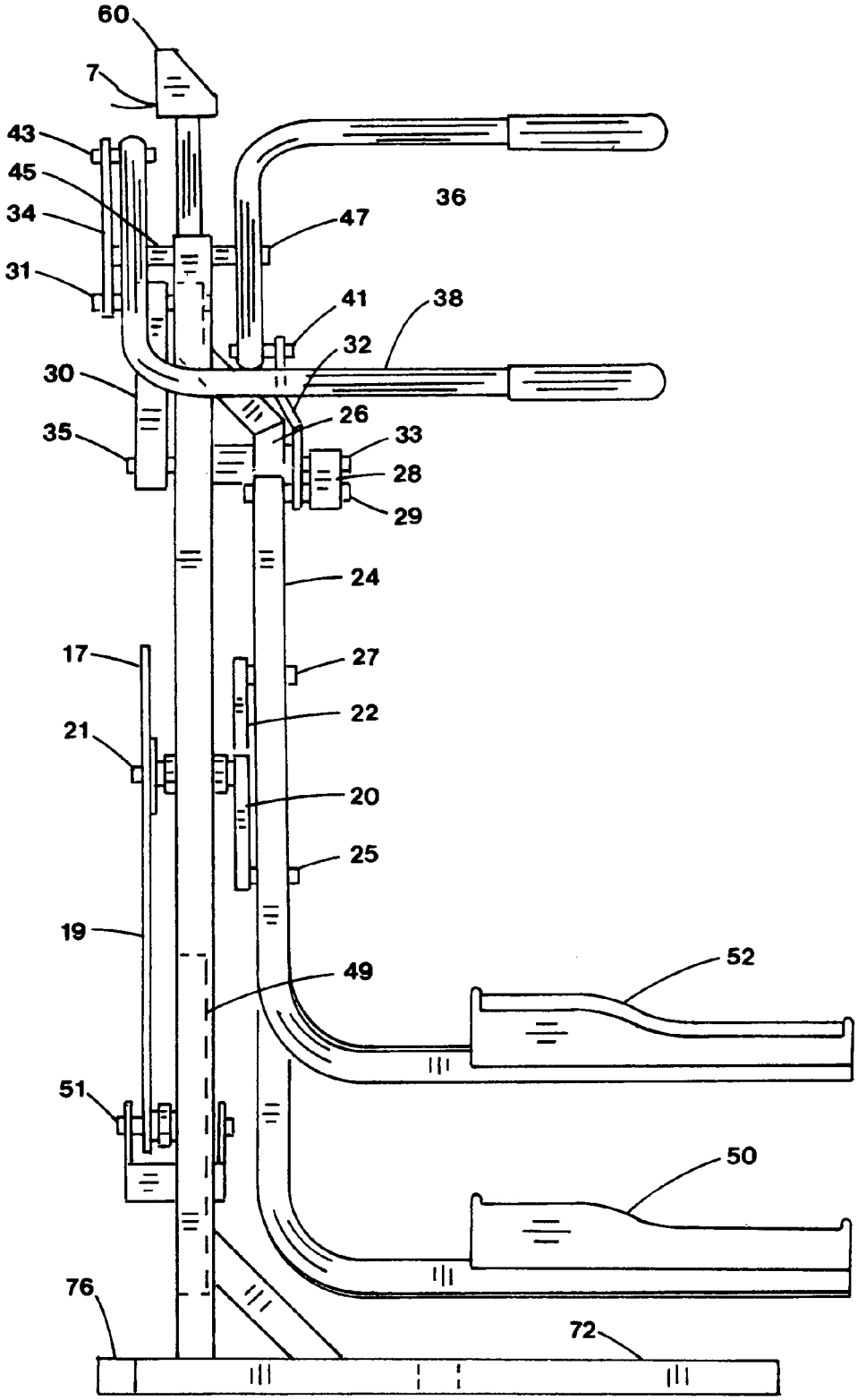
FIG. 2 is the side view of the preferred embodiment shown in FIG. 1.

Referring to the drawings in detail, pedals 50 and 52 are shown in FIGS. 1 and 2 in the lowermost and uppermost positions of the preferred embodiment. Pedals 50 and 52 are positioned on the ends of foot supports 24 and 26 and traverse horizontally elongated closed loop paths 3 and 5. Cranks 20,22 rotate about pivot axis 21,23 and are pivotally connected to foot supports 24,26 at pivots 25,27. Meshed gears 16 and 18 rotate about pivot axes 21,23 and with cranks 20,22 causing them to rotate in opposite directions.

Rocker links 28,30 are connected to foot supports 24,26 at pivots 29,31 and to the framework 70 at pivots 33,35. Body weight causes pedal 52 to lower on the inside portion of elongated curve 5 while pedal 50 rises on the outer portion of elongated curve 3 with lateral motion. When pedal 50 begins the downward decent along the inner portion of curve 3, pedal 52 rises along the outer portion of curve 5 with lateral elliptical foot motion.

Pulley 17 rotates with crank 20 about pivot axis 21. Belt 19 is engaged with pulley 17 and drives flywheel 49 about pivot axis 51. Friction belt 53 wraps flywheel 49 to provide load resistance which is adjustable using actuator 14 through wires 11 connected to wires 7 of control system 60 by conventional means.

Arm exercise is provided along side the operator by handles 36,38 which rotate about pivots 47,45. Connecting links 32,34 are pivotally connected to handles 36,38 at pivots 41,43 and to foot supports 24,26 at pivots 29,31.

Framework 70 supports pivot axes 21,23, rocker link pivots 33,35, handle pivots 45,47, flywheel pivot 51 and actuator 14. Framework 70 connects to horizontal frame members 72,74 which are configured to rest on a horizontal surface. Frame member 76 connects frame members 72 and 74. Rocker link pivots 33,35 of rocker links 28,30 can be repositioned to alternate locations 61 or 63 on framework 70 so that the orientation of pedal curves 3,5 are changed for different exercise. The relocation of rocker link pivots 33,35 can be manual or by actuator 91 as shown in FIG. 3 with control system 60.

Figure 3:
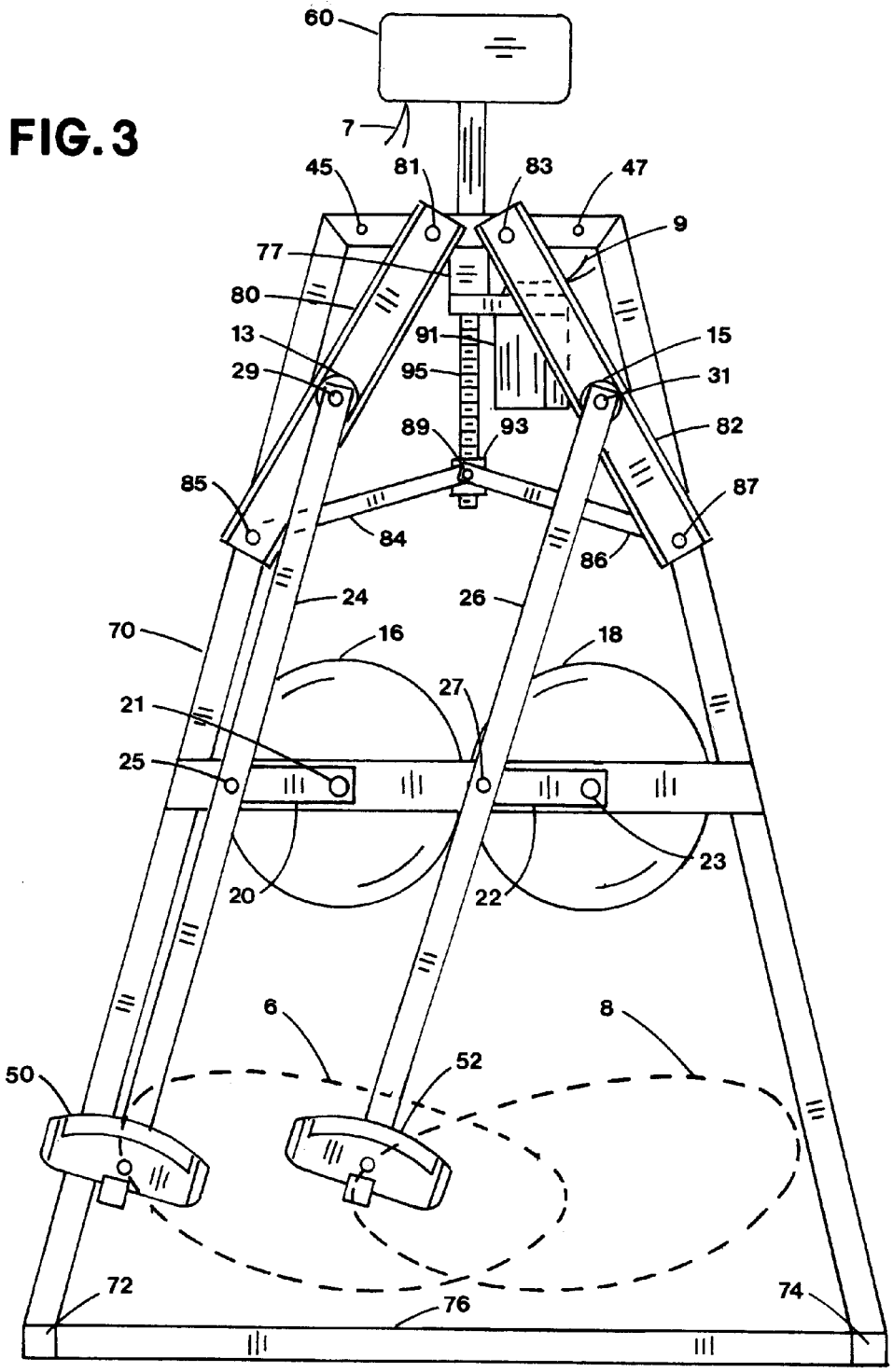
FIG. 3 is a frontal view of an alternate embodiment using guide tracks adjusted apart.
Figure 4:
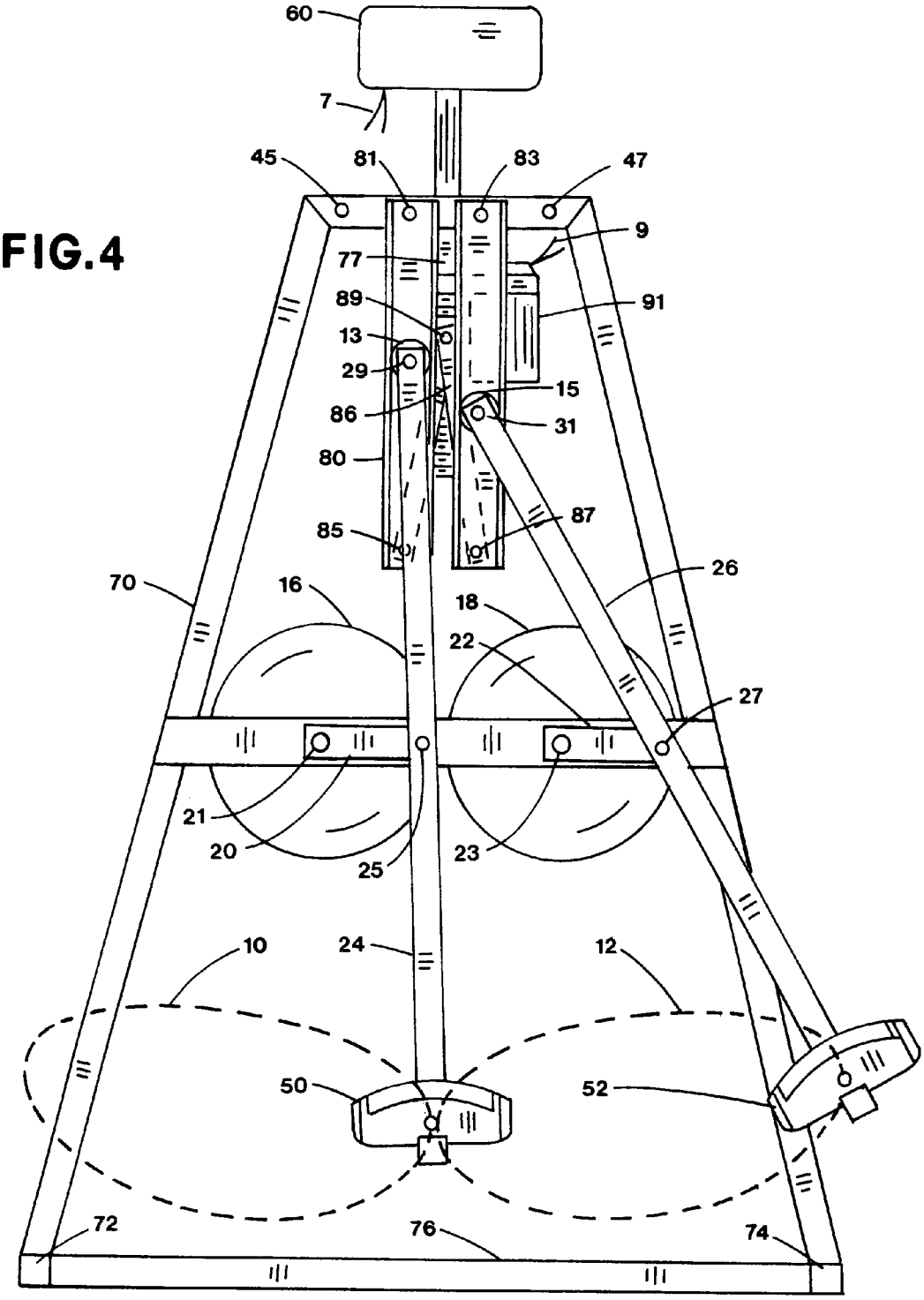
FIG. 4 is a frontal view of the alternate embodiment of FIG. 3 with the guide tracks adjusted close together.

An alternate embodiment is shown in FIGS. 3 and 4 where the rocker link guides 28,30 have been replaced with guide tracks 80,82. Rollers 13,15 rotate about pivots 29,31 and are in rollable contact with guide tracks 80,82. Guide tracks 80,82 are connected to frame member 70 at pivots 81,83. Actuator 91 is supported by bracket 77 which connects to frame member 70. Adjustment links 84,86 are connected to guide tracks 80,82 at pivots 85,87 and to actuator screw nut 93 at pivots 89. Actuator screw nut 93 can move along actuator screw 95 as directed by control system 60 through wires 7,9 connected by conventional means. The rest of the alternate embodiment is the same as the preferred embodiment of FIGS. 1 and 2 with the arm exercise handles 36,38 and flywheel 49 not shown for clarity.

FIG. 3 shows the lower portion of guide tracks 80,82 adjusted apart causing pedals 50,52 to follow pedal curves 6,8 with pedals 50,52 close together. FIG. 4 shows guide tracks 80,82 adjusted close together such that pedals 50,52 follow pedal curves 10,12 with pedals 50,52 further apart to exercise leg muscles differently.

Figure 5:
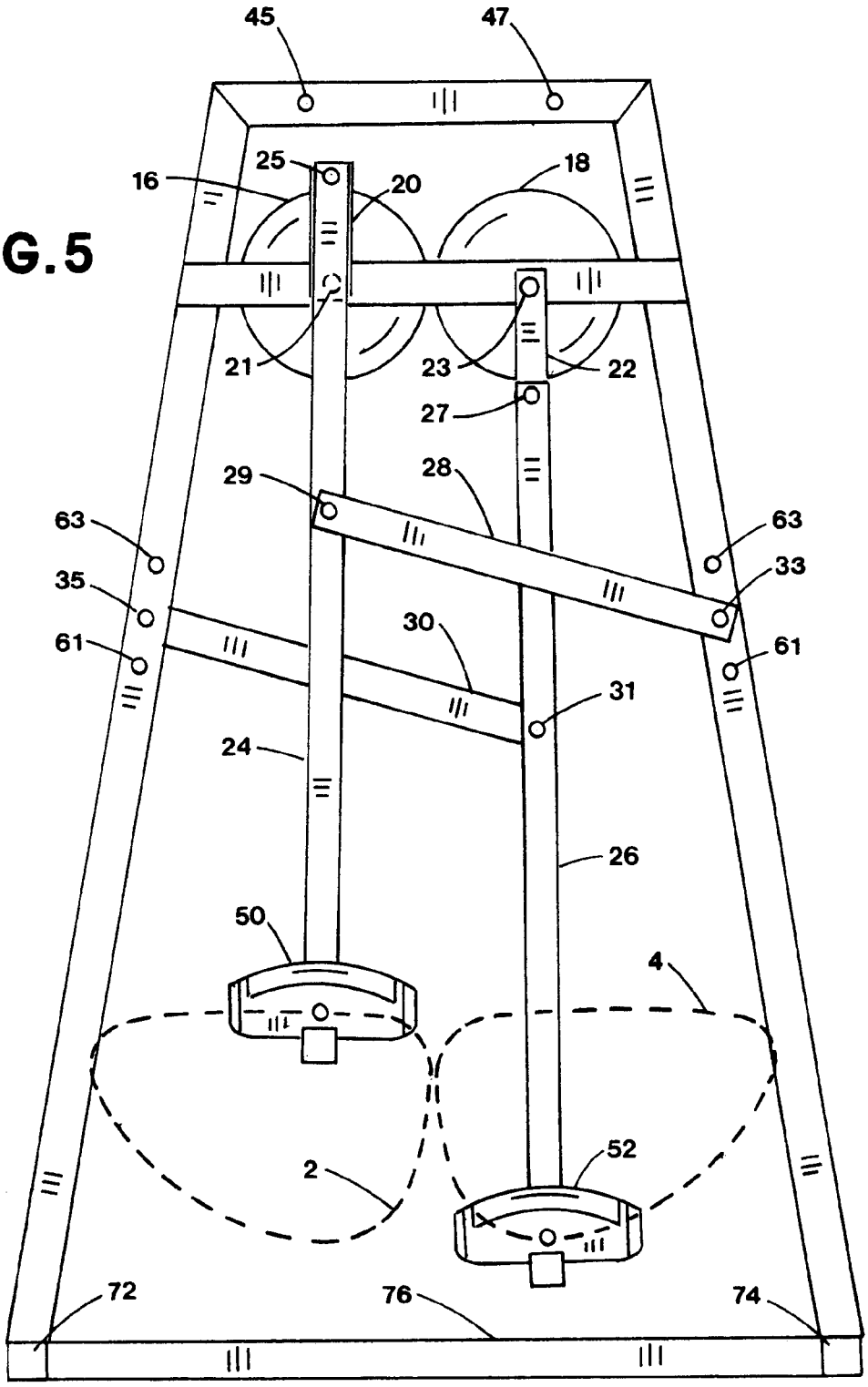
FIG. 5 is a frontal view of another alternate embodiment of FIG. 3 with the cranks positioned at the ends of the foot supports.

Another alternate embodiment is shown in FIG. 5 where the cranks 20,22 are positioned at the ends of foot supports 24,26. Rocker links 28,30 are positioned with pivots 29,31 intermediate foot supports 24,26. The exchange of cranks 20,22 and rockers 24,26 as compared to FIG. 1, results in pedal curves 2,4 which are more triangular in shape.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise apparatus comprising:

a framework, said framework configured to be supported by a horizontal surface;

a pair of cranks, each said crank rotatably connected to said framework at a respective separate pivot axis and configured to rotate through continuous full rotations during operation of said exercise apparatus;

a coupling device, said coupling device configured to cause said cranks to have operably associated opposing rotation about each separate said pivot axis;

a pair of foot supports, each said foot support pivotally connected to a respective said crank and having a foot engaging pedal positioned at one end of said foot support to follow a closed loop elongate curve;

a pair of guides, each said guide operably associated with a respective said foot support and said framework to cause a portion of said foot support to have a generally up and down movement, and wherein said guides remain located vertically above said foot engaging pedals with respect to said horizontal surface during use of the apparatus;

said pedals configured to move relative to said framework when the foot of the operator is rotating said crank whereby said pedals follow laterally displaced separate said closed loop elongate curves with movement that is lateral to said operator.

2. The exercise apparatus according to claim 1 wherein said coupling device causes one said crank to rotate about said respective separate pivot axis in a direction opposite to the rotation of the other said crank about said respective separate pivot axis.

3. The exercise apparatus according to claim 1 further comprising arm exercise, said arm exercise operably associated with said foot supports and configured to reciprocate while said cranks continuously rotate.

4. The exercise apparatus according to claim 3 wherein said arm exercise comprises a pair of handles, each said handle operably associated with a corresponding said foot support.

5. The exercise apparatus according to claim 1 further comprising a flywheel, said flywheel rotatably connected to said framework and operably associated with said cranks to rotate with continuous rotation.

6. The exercise apparatus according to claim 5 further comprising a load resistance, said load resistance operably associated with said flywheel, a means for adjustment of said load resistance and, a control system, said control system positioned within reach of the operator whereby said load resistance can be varied during operation of said exercise apparatus.

7. The exercise apparatus according to claim 1 wherein said coupling device is a pair of gears, each said gear attached to a respective said crank to rotate about said pivot axis whereby one said crank rotates opposite to the other said crank and each said gear having teeth directly meshed with the other said gear.

8. The exercise apparatus according to claim 1 wherein said guides are operably associated with an adjustment device, said adjustment device configured to change the orientation of said closed loop elongate curve for said pedal.

9. The exercise apparatus according to claim 8 wherein said adjustment device is an actuator, said actuator operably associated with said guides and a control system such that said control system can change the position of said guides in opposing angular directions relative to said framework during operation of said exercise apparatus.

10. The exercise apparatus according to claim 1 wherein said guide comprises a rocker link, said rocker link pivotally connected to said foot support and said framework.

11. The exercise apparatus according to claim 1 wherein said guide comprises a roller and track, said roller pivotally connected to said foot support and in rollable contact with said track, said track connected to said framework.

12. An exercise apparatus comprising:

a framework, said framework configured to be supported by a horizontal surface;

a pair of cranks, each said crank rotatably connected to said framework at a respective separate pivot axis and configured to rotate through continuous full rotations during operation of said exercise apparatus;

a pair of gears, each said gear attached to a respective said crank to rotate about a respective separate said pivot axis and each said gear having teeth directly meshed with the other said gear;

a pair of foot supports, each said foot support pivotally connected to a respective said crank;

a pair of pedals, each said pedal attached to a respective foot support at one end protruding outwardly thereof and following a separate laterally displaced closed loop elongate curve;

a pair of guides, each said guide operably associated with a respective said foot support and said framework;

said pedals configured to move relative to said framework when the foot of the operator is rotating said cranks whereby one said pedal follows one said closed loop elongate curve moving lateral to one side of the operator while the other said pedal is moving lateral to the other side of said user along the other said closed loop elongate curve.

13. The exercise apparatus according to claim 12 further comprising arm exercise, said arm exercise operably associated with said foot support and configured to reciprocate while said cranks continuously rotate.

14. The exercise apparatus according to claim 12 wherein said guides are operably associated with an adjustment device, said adjustment device configured to change the orientation of said closed loop elongate curves for said pedals.

15. The exercise apparatus according to claim 12 wherein said guide comprises a rocker link, said rocker link pivotally connected to said foot support and said framework.

16. The exercise apparatus according to claim 12 wherein said guide comprises a roller and track, said roller pivotally connected to said foot support and in rollable contact with said track, said track connected to said framework.

17. An exercise apparatus comprising:

a framework, said framework configured to be supported by a horizontal surface;

a pair of cranks, each said crank rotatably connected to said framework at a respective separate pivot axis and configured to rotate through continuous full rotations during operation of said exercise apparatus;

a coupling device, said coupling device configured to cause said cranks to have operably associated opposing rotation about each separate said pivot axis;

a pair of foot supports, each said foot support pivotally connected to a respective said crank and having a foot engaging pedal positioned at one end of said foot support;

a pair of guides, each said guide operably associated with a respective said foot support and said framework to cause a portion of said foot support to have a generally up and down movement, and wherein said guides remain located vertically above said foot engaging pedals with respect to said horizontal surface during use of the apparatus;

an adjustment device, said adjustment device operably associated with said guides and said framework to change the position of said guides in opposing angular directions during operation of said exercise apparatus;

said pedals configured to move relative to said framework when the foot of the operator is rotating said cranks whereby each said pedal follows a separate closed loop elongate curve with movement that is sideways to an operator and said adjustment device can laterally change the position of each said closed loop elongate curve.

18. The exercise apparatus according to claim 17 further comprising a control system, said control system operably associated with said adjustment device and positioned within reach of the operator whereby the position of said guides can be varied during operation of said exercise apparatus to cause said pedals to operate laterally closer together or further apart.

19. The exercise apparatus according to claim 17 further comprising arm exercise, said arm exercise operably associated with said foot supports and configured to reciprocate while said cranks continuously rotate.

20. The exercise apparatus according to claim 17 wherein said coupling device is a pair of gears, each gear attached to a respective said crank to rotate about said pivot axis whereby one said crank rotates opposite to the other said crank and each said gear having teeth directly meshed with the other said gear.

* * * * *